US005495949A

United States Patent [19]

Olivier

[11] Patent Number: 5,495,949

[45] **Date of Patent: * Mar. 5, 1996**

[54] SYSTEM FOR TREATING SOLID PARTICLES IN A MEDIUM

[76] Inventor: Paul A. Olivier, Handzamestnoat 159, B-8610 Handzame, Belgium

[ * ] Notice: The portion of the term of this patent subsequent to Dec. 21, 2012, has been disclaimed.

[21] Appl. No.: 88,538

[22] Filed: Jul. 9, 1993

[51] Int. Cl.[6] ..... B03B 5/42

[52] U.S. Cl. ..... 209/172.5; 209/452

[58] Field of Search ..... 209/16, 155, 157, 209/172, 172.5, 173, 451, 452

[56] References Cited

U.S. PATENT DOCUMENTS

| | | | |
|---|---|---|---|
| 1,559,938 | 11/1925 | Chance | 209/452 X |
| 2,314,871 | 3/1943 | De Back | 209/452 X |
| 2,983,378 | 5/1961 | Hilkemeier | 209/452 X |
| 4,234,415 | 11/1980 | de Tuya Casuso | 209/172.5 |
| 4,323,449 | 4/1982 | Pelletier | 209/452 X |
| 4,944,869 | 7/1990 | Lyakov et al. | 209/452 X |
| 5,169,005 | 12/1992 | Beane | 209/172.5 |

FOREIGN PATENT DOCUMENTS

| | | | |
|---|---|---|---|
| 29704 | 6/1981 | European Pat. Off. . | |
| 533027 | 2/1922 | France . | |
| 866046 | 6/1941 | France . | |
| 960801 | 3/1957 | Germany . | |
| 3132162 | 3/1983 | Germany . | |
| 5-15808 | 1/1993 | Japan | 209/452 |

*Primary Examiner*—William E. Terrell
*Assistant Examiner*—Tuan Nguyen
*Attorney, Agent, or Firm*—Sughrue, Mion, Zinn, Macpeak & Seas

[57] ABSTRACT

A system both for the treatment of solid particles in a liquid and also for the treatment of a liquid by solid particles. The system includes a first scrolled barrel containing a liquid bath in which the treatment takes place, a second scrolled barrel attached to and communicating with the first barrel, the second barrel being constructed to prevent the free flow of liquid out of the bottom of the bath while at the same time allowing for the free passage of solid particles through the bottom of the bath, and a shaft for rotating the barrels. Both the first and second barrels are designed so as to insure a substantially uniform liquid level in the bath.

22 Claims, 7 Drawing Sheets

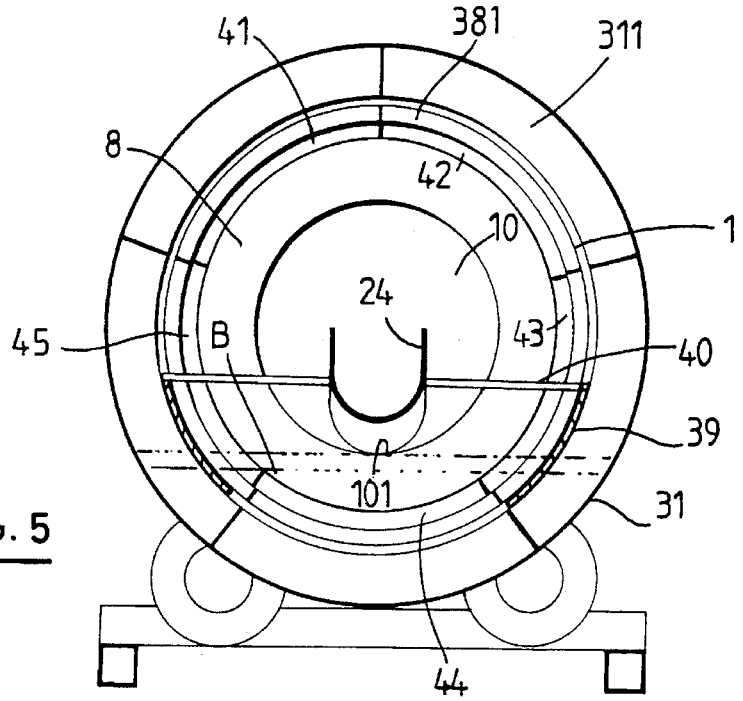
FIG. 5
FIG. 8
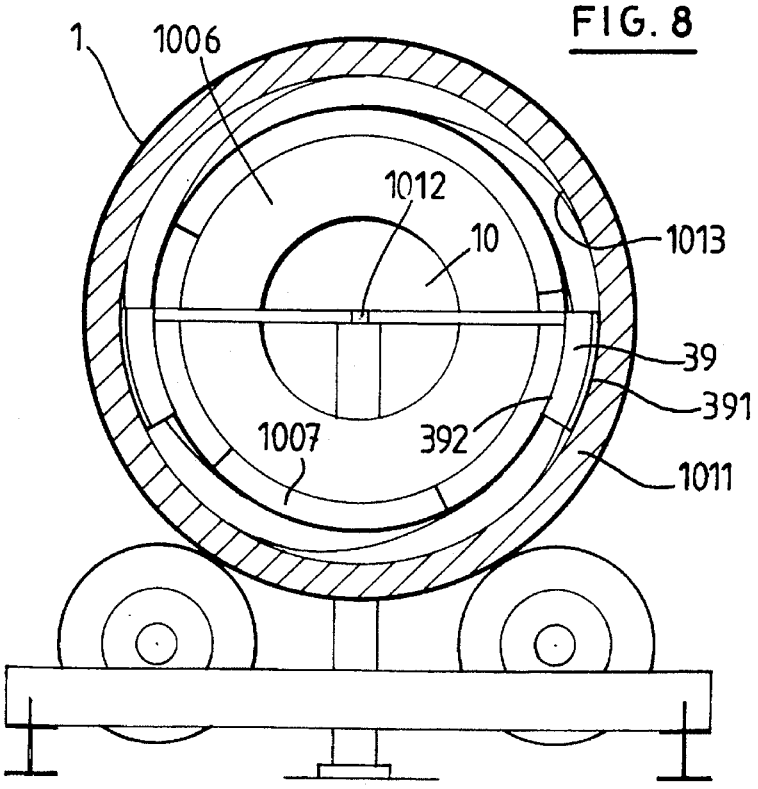

SYSTEM FOR TREATING SOLID PARTICLES IN A MEDIUM

The present invention relates to a system for treating solid particles within a liquid bath, said system comprised of a first scrolled barrel or part thereof wherein the treatment takes place, a second scrolled barrel or part thereof attached to and communicating with the first barrel or part thereof, said second barrel or part thereof being provided with a means for preventing the freeflow of medium from out of the bottom of the bath while at the same time allowing for the free passage of solid particles through the bath, and a means for rotating the two barrels or parts thereof.

THE PRIOR ART

Many devices exist to get solid particles into or out of a liquid bath: launder pipes, chutes, conveyor belts, screws, vibratory trays, vibratory dewatering screens, cones, bucket wheels, rotary disks, etc. Many of these devices are quite adequate in terms of introducing solids into a liquid bath, but they are all quite limited in their capacity to evacuate solid particles in a cost effective and efficient manner. All devices for removing solid particles from a liquid bath all involve the upward movement of these particles relative to the bath. Moreover, in removing the solid particles, all these devices require that the solid particles are lifted to some point above the bath.

The present invention overcomes the difficulties surrounding the evacuation of solids from a liquid bath. It allows large quantities of solid particles to be evacuated simply and efficiently with a small initial capital cost, requiring little energy or power, and incurring little wear or abrasion. In fact, in its preferred embodiment, it even allows solid particles to be removed from a liquid bath without having to lift the particles out of a bath and at the same time without disturbing the dynamics of the bath in any significant way. The present invention, in its preferred embodiment, in evacuating solid particles from a liquid bath, does not require any upward movement of the solid particles relative to the bath, and it does not require that the solid particles be lifted to some point above the bath.

BRIEF DESCRIPTION OF THE INVENTION

The present invention relates to a system both for the treatment of solid particles in a liquid and for the treatment of a liquid by means of solid particles. This treatment may involve, for example, scrubbing, mixing, separating, rinsing, chemical and biochemical reactions, lixiviation, etc.

A system according to the invention is comprised of a first scrolled barrel containing the liquid bath wherein the treatment takes place, a second scrolled barrel attached to and communicating with the first barrel, said second barrel being provided with a means for preventing the freeflow of liquid out of the bottom of the bath while at the same time allowing for the free passage of solid particles through the bottom of the bath, and a means for rotating the two barrels. In addition, both the first and second barrels are provided with means for insuring a substantially uniform liquid level in the bath.

Said second scrolled barrel is provided, according to an embodiment, with an element which covers or links at least a part of its scrolls or scroll in such a way that it prevents the liquid from flowing freely through the linked or covered scrolls or scroll. In this way the liquid in the bath is not disturbed. Both the first and second barrels have elements which maintain the level of the liquid in the bath, these elements being either in the form of a cone or a doughnut, with or without an opening for removing medium or floating particles from the bath.

The second scrolled barrel has two basic forms. The first form allows for the eventual evacuation of the sinking solid particles by continuing their movement in the same direction as in the first scrolled barrel. The second form allows for the eventual evacuation of said solide particles by reversing their movement relative to the direction of their movement in the first scrolled barrel.

In both forms of this second scrolled barrel, the inner diameter of this second barrel is advantageously greater than the inner diameter of the first barrel. This gives the second barrel an even greater capacity for removing sinking solid particles. As the sinking solid particles exit the first barrel, they fall downward into the second barrel where they are eventually evacuated from the bath. This downward movement implies far less wear, abrasion and energy relative to other evacuation devices which all lift the sinking solid particles out of the bath.

Since the inner diameter of this second barrel is advantageously greater than the inner diameter of the first barrel, it is possible to insert curtains which serve, for example in the event of separation, to prevent any floating solid particles from crossing over and reporting with the sinking solid particles. Advantageously, two curtains extend down into the medium and prevent floating solid particles from mixing with the sinking solid particles. In the first form of the second scrolled barrel, the two curtains close off the surface gap between the first scrolled barrel and that element which links or covers the scroll of the second barrel. In the second form of the second scrolled barrel, the two curtains close off the surface gap between the first scrolled barrel and the level-maintaining doughnut of the second barrel. In both cases, by closing off this gap, floating solid particles are effectively prevented from mixing with the sinking solid particles. In a preferred embodiment, that portion of the curtain actually making contact consists of an elastomeric material.

Another system according to the invention for treating either solid particles in a liquid bath or a liquid by means of solid particles, is comprised of a single scrolled barrel which is comprised further of two parts: a first part wherein the treatment takes place, and a second part provided with a means for preventing the freeflow of liquid from out of the bottom of the bath while at the same time allowing for the free passage of solid particles through the bottom of the bath, and a means for rotating the barrel. The barrel is also provided with means for assuring a substantially uniform liquid level in the bath. According to an embodiment of this system, an element covers or links at least part or parts of the scrolls or scroll of the barrel in such a way that it prevents the liquid from flowing freely through the linked or covered scrolls or scroll.

According to an embodiment of this other system, the barrel is rotated along its longitudinal axis, the barrel being provided with an inner annular protrusion having such a height that the free end of said protrusion directed towards said longitudinal axis is located at a distance from said longitudinal axis which is at most equal to the distance separating the free ends of the parts of the scrolls adjacent to the said inner annular protrusion, the said inner annular protrusion separating the barrel into the two said parts. When said embodiment is used for separating sinking solid particles from floating particles, the gap formed between the element and the protrusion is partly closed by two curtains, said curtains extending down in the bath for preventing floating particles from crossing and reporting with the solid particles passing through the gap.

Still another system according to the invention which is particularly suitable for treatment such as scrubbing is comprised of a single barrel which is comprised of three parts: namely, a central part wherein the treatment takes place, and two end parts provided with a means for preventing the freeflow of liquid from out of the bottom of the bath while at the same time allowing for the free passage of solid particles through the bottom of the bath, and a means for rotating the barrel. This barrel is further provided with means for assuring a substantially uniform liquid level in the bath. Indeed a first end part acts as means for feeding solid particles, possibly together with medium or liquid, into the central part, while the other end part acts as means for evacuating solid particles, together with some medium or liquid, from the central part.

According to an embodiment of said last embodiment, the barrel is provided with two elements, a first element linking parts of scrolls or scroll of its first end part in such a way that it prevents liquid from flowing freely through the linked parts of scrolls or scroll of said first end part, while the second element links parts of scrolls or scroll of its second end part in such a way that it prevents liquid from flowing freely through the linked parts of scrolls or scroll of said second end part.

In a preferred embodiment of said last embodiment, the barrel is rotated along its longitudinal axis and is provided with an inner annular protrusion having such a height that the free end of said protrusion directed towards said longitudinal axis is located at a distance from said longitudinal axis which is at most equal to the distance separating the free ends of the parts of the scrolls adjacent to the said inner annular protrusion, the said inner annular protrusion separating the central part from the second end part. The barrel is provided with an element linking parts of its scrolls in its second end part in such a way that it prevents liquid from flowing freely through the linked parts of scrolls of said second end part, and in such a way that a gap is formed between the said element and the protrusion, said system being provided with two curtains closing partly said gap, said curtains extending down in the bath for preventing floating particles from crossing and reporting with the solid particles passing through the gap.

BRIEF DESCRIPTION OF THE DRAWINGS

FIG. 5 is a cross section view along line V—V of the system shown in FIG. 4;

FIG. 8 is a cross section view along line VIII—VIII of the system of FIG. 7.

DESCRIPTION OF EMBODIMENTS OF THE INVENTION

The embodiments of FIG. 1 to 4 described hereafter are particularly suitable for heavy media separation, but are also suitable for other uses, such scrubbing, treatment of liquids as waste water with solid such as lime, dolomite, calcium carbonate.

Figure 1:
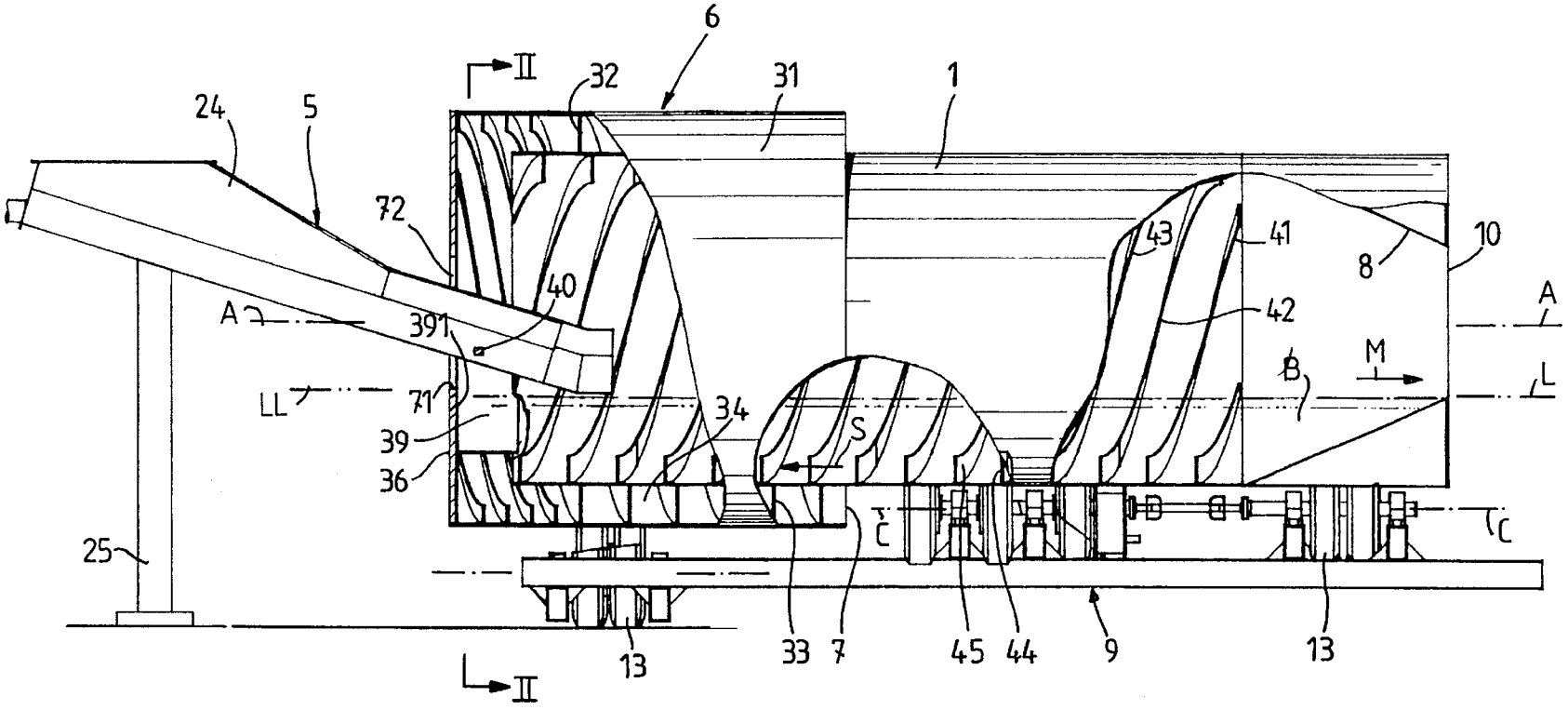
FIG. 1 is a side view with cross sections of an embodiment of a system according to the invention.
Figure 2:
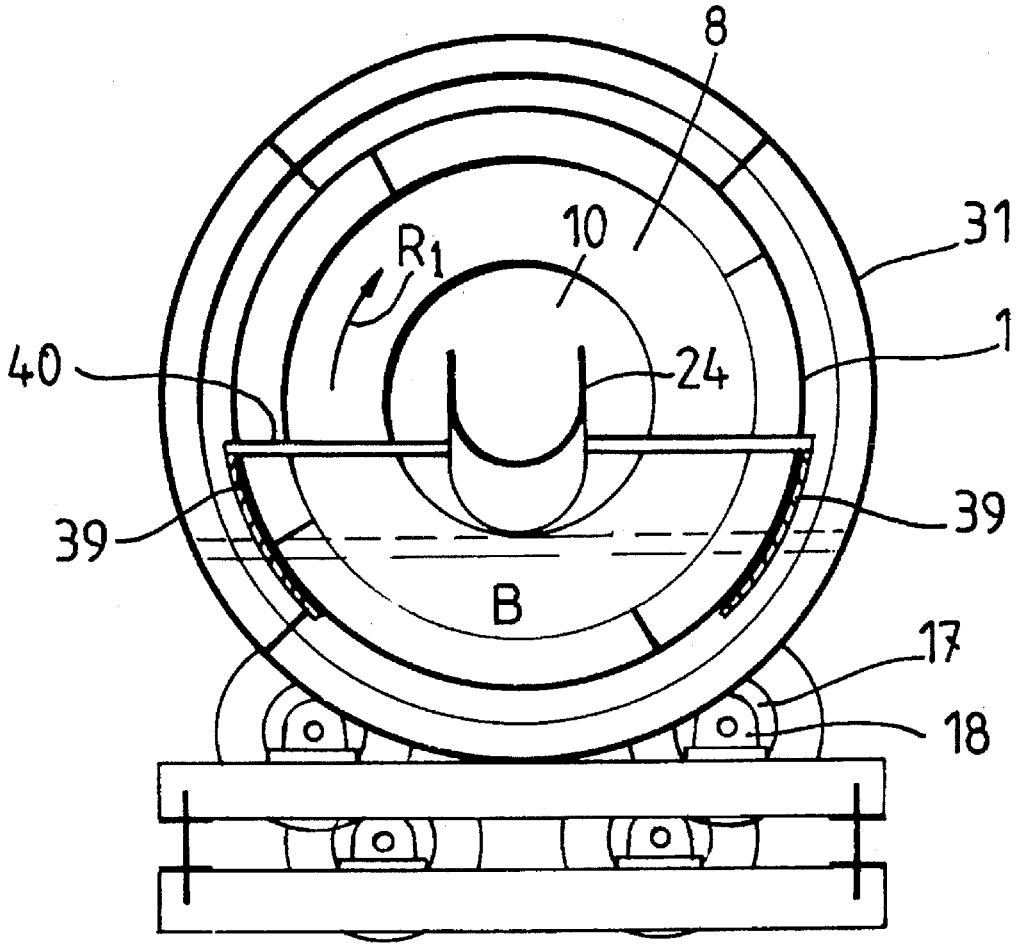
FIG. 2 is a cross section view along the line II—II of the system shown in FIG. 1.

FIG. 1 shows a system for separating solid particles in two fractions by means of a medium, the specific gravity of which being comprised between the specific gravity of a first fraction—the floating fraction, and the specific gravity of the second fraction—the sinking fraction.

The system comprises:

(a) a first longitudinal scrolled barrel 1 in which the separation takes place, said barrel being provided with five scrolls 41, 42, 43, 44, 45 having a right-handed pitch;

(b) means 5 for feeding a mixture medium and solid particles to be separated;

(c) means 6 for evacuating through an opening 7 the sink fraction out of the system;

(d) a discharge 8 in the form of a cone associated with said barrel 1 for removing through an opening 10 the float fraction as well as medium, and (e) means 9 associated with said barrel 1 for driving it rotatively along a longitudinal axis A—A.

The opening 10 of the discharge 8 has a lower edge 101 located at a level L lower than the level LL of the lower edge 71 of the opening 72 through which the mixture is fed into the barrel 1.

The means 9 rotates clockwise R1 the barrel 1 so as to ensure the movement of the sink fraction towards the means for removing the sink fraction (arrow S).

The barrel 1 is supported by pneumatic tires 13. Seven tires 13 located on the left side of the barrel 1 while seven other tires 14 being located on the right side of barrel 1.

Said tires 13 are mounted on shaft 15, the axis C—C of which are parallel to the central axis A—A of the barrel 1. Said shafts are held in place by ball bearings 17 located at the free end of uprights 18. One shaft is driven by a motor not shown such as an electrical motor or a diesel motor, via pulley connecting a sheave secured on shaft with a sheave secured on the shaft of the motor. Due to the rotation of the shaft of the motor, tires 13 are driven so that due to the friction of said tires 13 on barrel 1, the latter is turned along its longitudinal axis A—A. The means 5 for feeding the mixture of medium and solid particles to be separated consists of an injector 24 held in position by a structure 25. This injector 24 is inclined so that particles present in said injector 24 move in the direction of barrel 1, said injector 24 is within the inner separatory space of the barrel 1.

Like barrel 1, barrel 31 is scrolled. Said barrel 31 attaches to and communicates with barrel 1, thereby acting as means 6 for evacuating the sink fraction.

In the embodiment as shown, the central axis of the second barrel 31 corresponds to the central axis of the first barrel 1 and is the rotation axis of said barrels.

The barrel 31 is attached to barrel 1 by means of scrolls 32, 33 of barrel 31. Barrel 1, i.e. its outer surface, acts as element for linking scrolls of barrel 31 so as to define a passage 34 wherein scrolls stretch so as to prevent the freeflow of medium through said passage and the opening 7.

The second barrel 31 is provided with an end wall or doughnut 36 showing the opening 72 through which the solid particles to be treated are fed through the injector 24, said end wall or doughnut 36 acting as means for preventing any flow of medium out of barrel 31 in a direction opposite to barrel 1.

Thus, the freeflow of medium M out of the system is only possible through opening 10, while the removal of medium through opening 7 with sinking particles is not free as it depends on the rotation speed of the barrel 1, 31.

In the embodiment of FIG. 1, barrel 1 is provided with scrolls having a right-handed pitch, while barrel 31 is provided with scrolls having left handed pitch (i.e. barrels 1 and 31 have scrolls with opposite handed pitch). The evacuation of sinking particles is thus obtained by reversing their movement relative to their movement in the first barrel.

In the embodiment shown, the central axis A—A is horizontal so that for evacuating the sink fraction out of the system, it is not necessary to raise upwardly the said sink fraction.

Barrel 31 has an inner diameter which is greater than the outer diameter of the barrel 1 so that the sinking particles escaping barrel 1 fall into barrel 31, where the sinking particles do not disturb the treatment of solid particles into barrel 1.

The doughnut 36 and the cone 8 act as means for assuring a uniform liquid level in the treatment bath B of barrel 1.

When the system of FIG. 1 is used for separating sinking solid particles from floating particles, the system is advantageously provided with curtains 39 extending down in the bath for preventing floating particles F from crossing and reporting with the solid particles passing through the bottom of the bath B into the barrel 31, i.e. all the floating particles F are evacuated through the opening 10.

The curtains are attached to arms 40 attached to the injector 24. The curtains are comprised of an arc section of a cylinder, one end edge 391 contacts the doughnut 26 while the other end of which contacts the element or first barrel 1.

Figure 3:
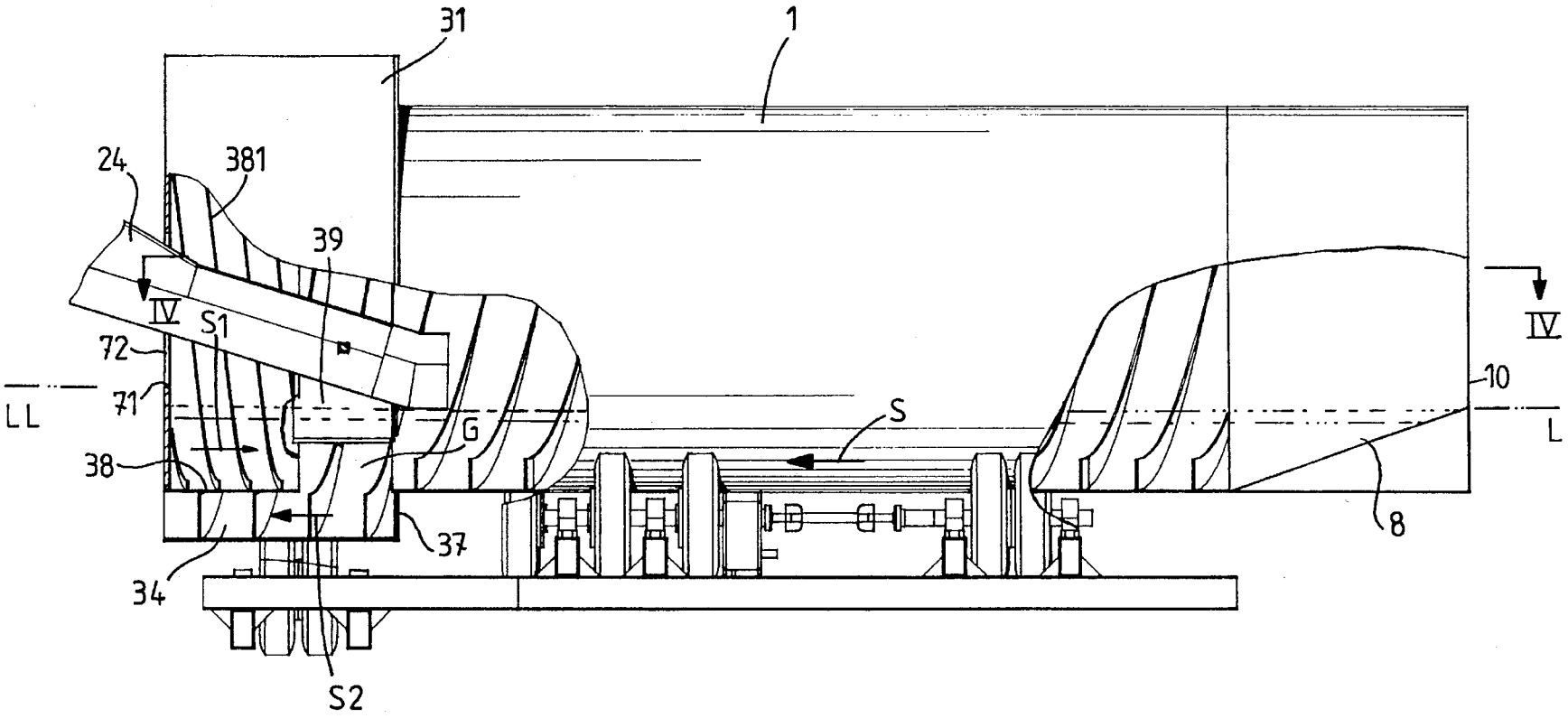
FIG. 3 is a side view of another embodiment of a system according to the invention.
Figure 4:
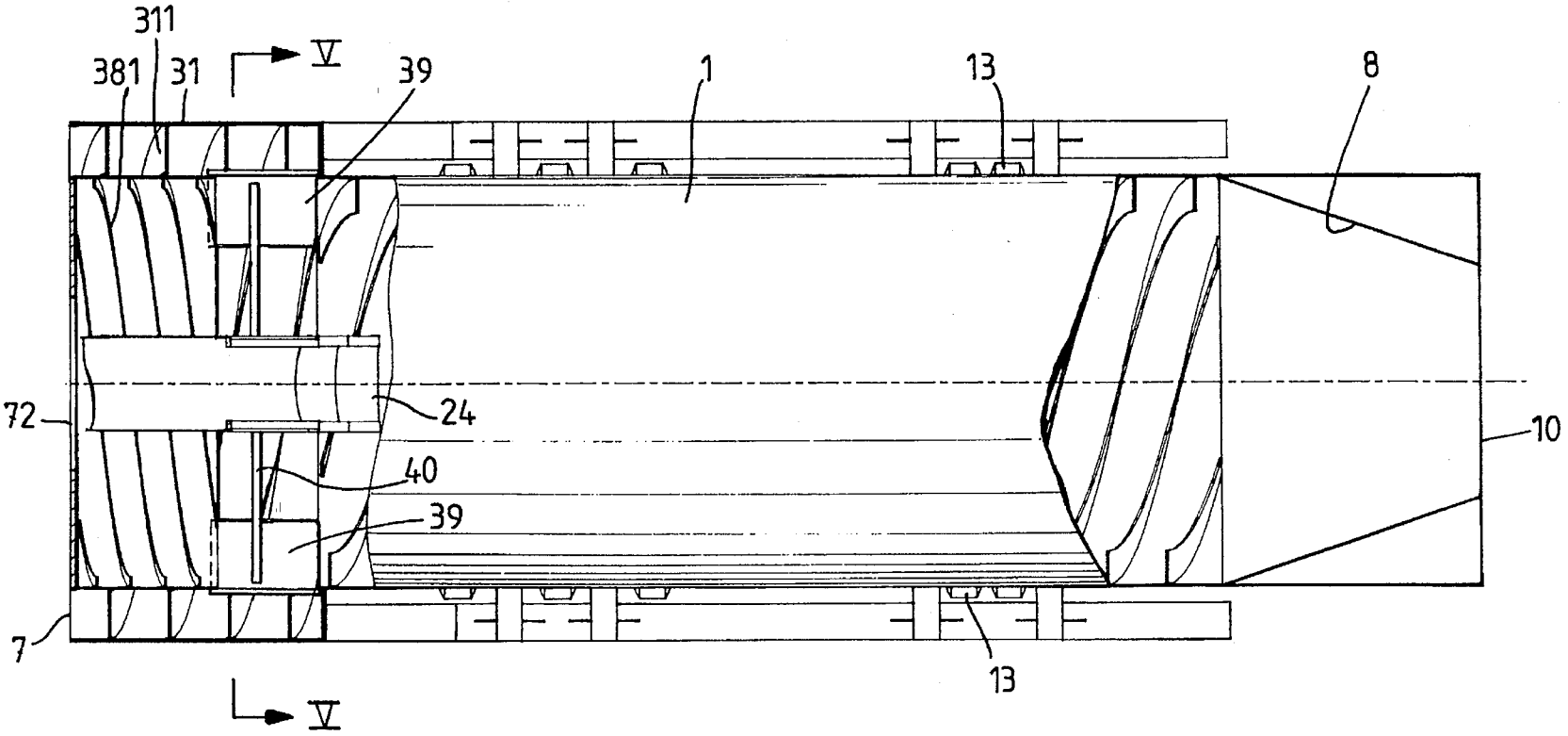
FIG. 4 is a cross section view along line IV—IV of the system shown in FIG. 3.

FIG. 3 is a view of a system similar to that shown in FIG. 1 except that barrel 31 is attached to barrel 1 by means of a flange 37 and forms an extension of barrel 1.

An inner cylinder 38 covers the free end of scrolls of the second barrel 31 so as to define a passage 34 wherein scrolls stretch, said passage acting as means for evacuating sinking solid particles.

The end of the cylinder 38 opposite to the end adjacent to barrel 1 is provided with a doughnut 36 having an opening 72 through which the solid particles are fed in barrel 1 together with medium by means of the injector. Said doughnut acts as means for preventing medium to flow freely out of the barrel 31 through the opening 72, as the level LL of the lower edge 71 of the opening 72 is located upwardly with respect to the lower edge 101 of the opening 10.

Said doughnut and the cone 8 act as means for assuring a substantially uniform level of the bath, i.e. for assuring a maximum level of the bath B.

In said embodiment, the sinking particles are evacuated through opening 7 by continuing their movement S2 in the passage 34 in the same direction S as in the first scrolled barrel.

As solid particles deposit on the inner surface of the cylinder 38, said inner surface is advantageously provided with scrolls 381 having a pitch opposite to the pitch of the first barrel 1, so that, when the barrels 1, 31 rotate, the sinking particles deposited on barrel 1 moves (S) towards the gap G formed between the cylinder 38 and the barrel 1, while the sinking particles deposited on the inner surface of the cylinder 38 also moves (S1 opposite to S) towards said gap G, i.e. so that the sinking particles fall into the barrel 31.

The solid particles falling in the barrel 31 are then moved towards the opening 7 through the scrolls of said barrel 31.

The parts of the scrolls 311 of the barrel 31 located in the gap G have advantageously such a height h that a curtain 39 is able to stretch from the outer surface of the cylinder 38 towards the first barrel, preferably to the flange 37.

As in the system of FIG. 1, two curtains 39 (arc section of a cylinder, the inner diameter of which is equal to or greater than the inner diameter of barrel 1 and than the inner diameter of cylinder 38) are secured to the injector 24 by means of arms 40. Said curtains contact the flange 37 and the cylinder 38 and extend down in the bath B for preventing floating particles from crossing and reporting with the sinking solid particles. Advantageously, the edges of the curtains making contact consist of an elastomeric material.

Figure 6:
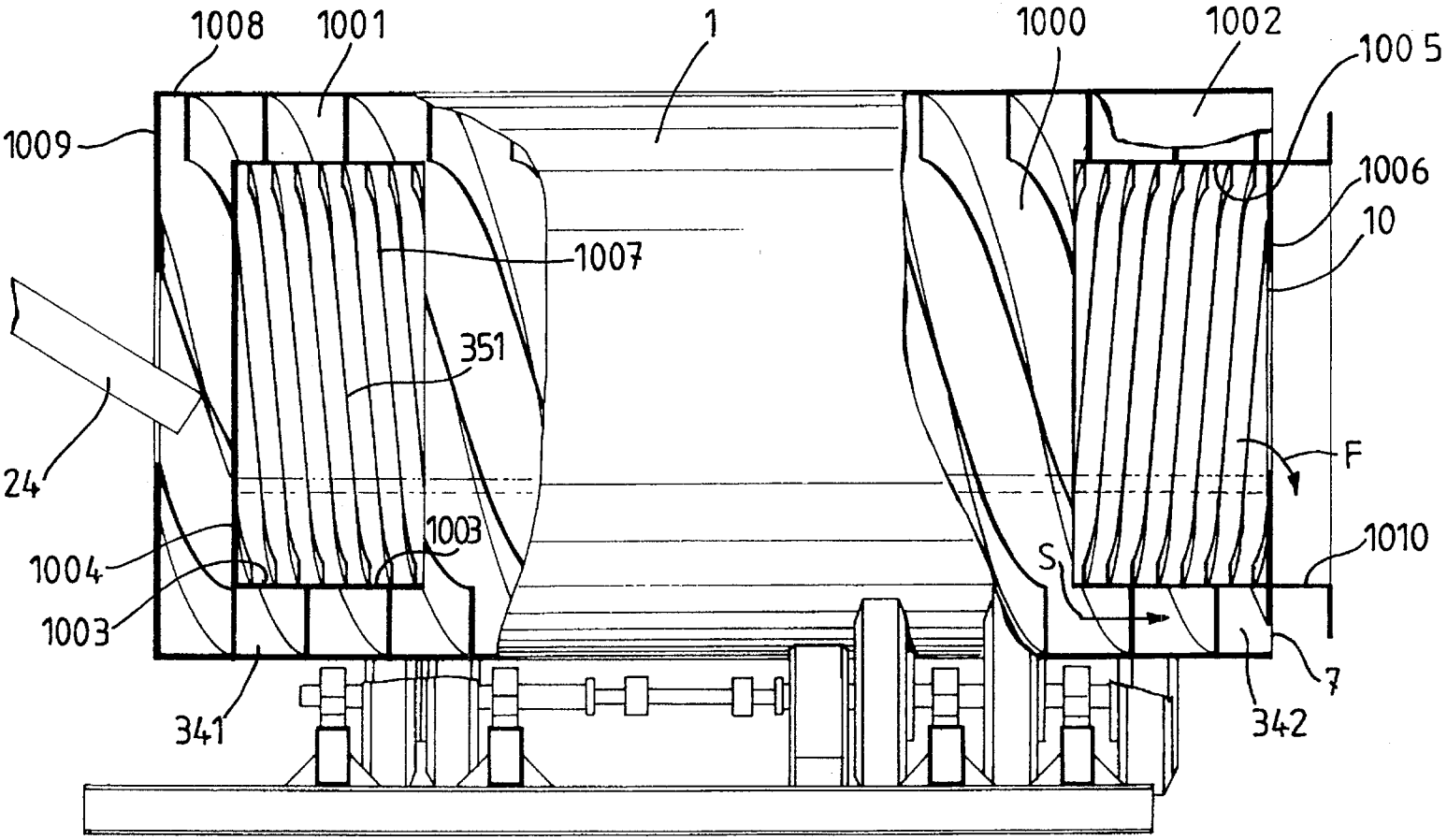
FIG. 6 is a side view with cross sections of a system according to the invention preferred for scrubbing solid particles.

FIG. 6 is a view of a another embodiment of a system according to the invention, preferred for the scrubbing of solid particles.

The system comprises a scrolled barrel 1 comprising three parts, a central part 1000 wherein the treatment takes place, a first end part 1001 for feeding solid particles into the central part and a second end part 1002 for evacuating solid particles through the bottom of the bath of the central part 1000.

Scrolls of the first end part 1001 are linked by a cylinder 1003 so as to define a passage 341. The scrolls stretching in the said passage 341 preventing the freeflow from out of the bath B through said passage.

The cylinder 1003 is provided with an doughnut 1004 so as to prevent any flow of medium from out the inner space 351 of cylinder 1003 in a direction opposite to the central part 1000.

Scrolls of the second end part 1002 are linked by a cylinder 1005 so as to define in said end part a passage 342. Scrolls stretching in the passage prevent the freeflow of medium through said passage 342.

The cylinder 1005 is provided with a doughnut 1006 having an opening 10 through which medium and float fraction are possibly discharged.

The cylinders 1003 and 1005 are provided with scrolls 1007 so as to ensure that any sinking particles deposited thereon will move towards the central part 1000 so as to be treated again or so as to be evacuated through passage 342.

Barrel 1 is provided with a scrolled extension 1008 with a wall 1009 in which the solid particles to be treated and possibly medium for the treatment are fed by means of the injector 24.

Cylinder 1005 is also provided with an extension 1010 in order to avoid that medium and floating particles F flowing through the opening 10 are mixed again with the medium and sinking particles S flowing through the opening 7.

The means for driving into rotation barrel 1 are for example similar to that disclosed for the system of FIG. 1 or that disclosed in U.S. Ser. No. 07/993 857.

Figure 7:
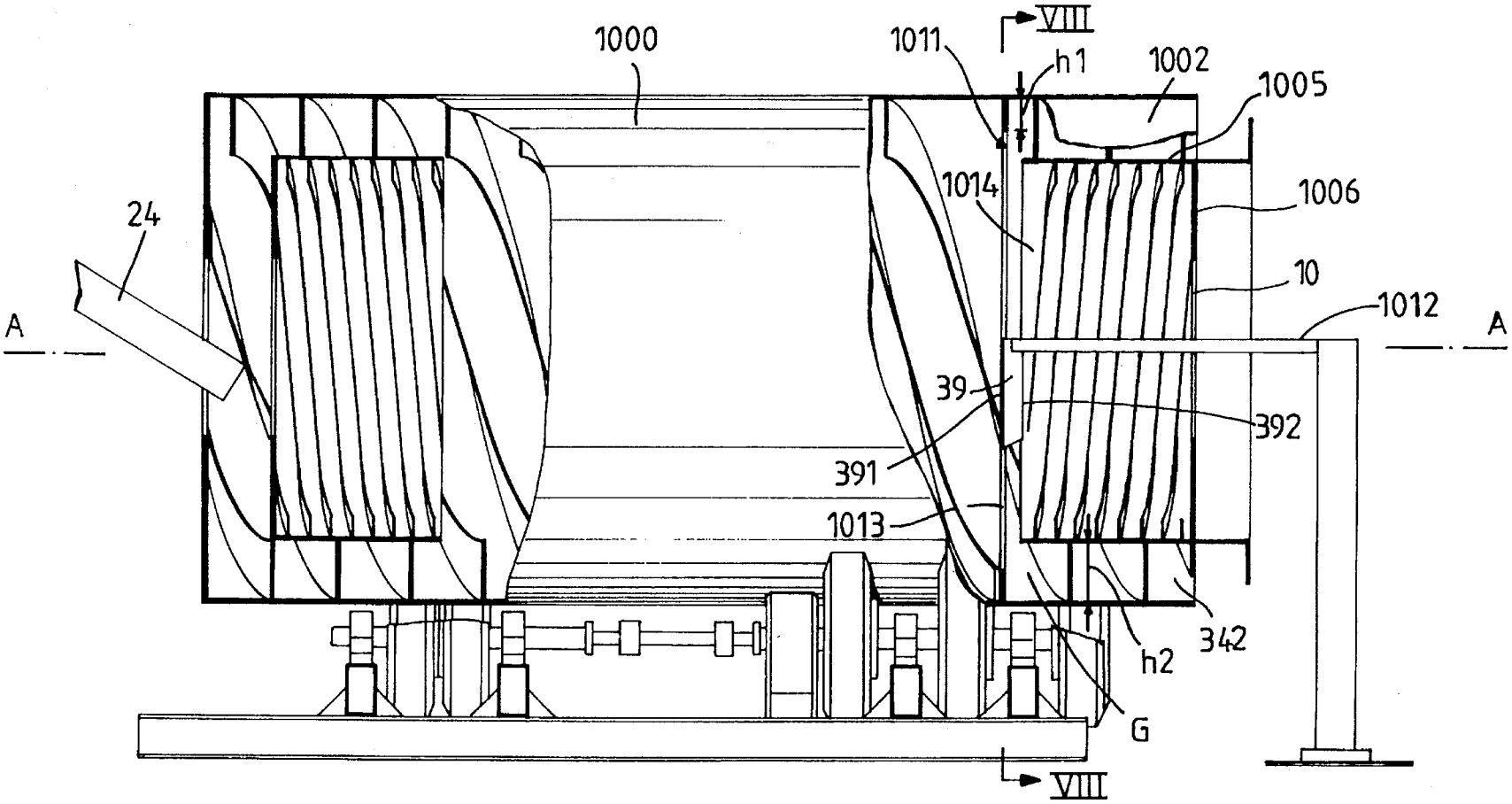
FIG. 7 is a side view of the system of FIG. 6 but for the separation of sinking solid particles from floating solid particles.

The system of FIG. 7 is similar to that shown in FIG. 6 except that it is provided with curtains for preventing floating particles from crossing over and reporting into the sinking solid particles removed through the passage 342. Such a system is thus particularly suitable for separating sinking solid particles from floating particles.

The barrel is provided with an inner annular protrusion 1011 which forms a separation between the central part 1000 and the second end part (evacuation) 1002, a gap being so created between said annular protrusion 1011 and the cylinder 1005. The height h1 of the protrusion 1011 is advantageously lower to the height h2 of the passage 342 and therefore to the height h2 of the scrolls of the second end part 1002.

The scrolls of the central part 1000 have a height equal to the height of the scroll in the second end part, except that said height decreases in the neightborough of the annular protrusion 1011.

The inner surface of cylinder 1005 is, in the neighborhood of the annular protrusion 1011, not provided with scroll so as to form a contact surface for curtains 39 for preventing floating particles from crossing and reporting with the sinking solid particles.

The system is provided with two curtains attached to an arm 1012 of a structure, said arm 1012 stretching through the opening 10 through which floating particles are removed. The curtains 39 close partly the gap G formed between the annular protrusion 1011 and the cylinder 1005 and extend down into the bath B. The curtains 39 (in the form of an arc section of a cone) have two opposite edges 391,392, a first contacting the surface 1013 of the protrusion 1011 directed towards the longitudinal axis A—A of the barrel while the other contacts the inner surface 1014 of the cylinder 1005 which is not provided with scrolls.

What I claim is:

1. A system for a solid particles—liquid treatment, said system comprised of (a) a first longitudinal scrolled barrel containing a liquid bath wherein the treatment takes places;

(b) a second scrolled barrel attached to and communicating with the first barrel, said second barrel being provided with a means for preventing the freeflow of medium from out of the bottom of the bath while at the same time allowing for the free passage of solid particles through the bottom of the bath;

(c) a means for insuring a substantially uniform liquid level in the bath, and (d) a means for rotating the two barrels.

2. The system of claim 1, in which the second barrel is provided with an element linking at least a part of its scrolls in such a way that it prevents the liquid from flowing freely through the linked part of its scrolls.

3. The system of claim 1, in which the second barrel is provided with an element covering at least a part of its scrolls in such a way that it prevents the liquid from flowing freely through the covered part of its scrolls.

4. The system of claim 1, in which the second barrel has an inner diameter which is greater than the inner diameter of the first barrel.

5. The system of claim 4 for separating sinking solid particles from floating particles, which system is provided with at least a curtain extending down in the bath for preventing floating particles on the bath from crossing and reporting with the solid particles passing through the bottom of the bath into the second barrel.

6. The system of claim 4 for separating sinking solid particles from floating particles, in which the second barrel is attached to the first barrel and is scrolled with respect to the first barrel, so that the direction of the movement of solid particles in said second barrel is reversed with respect to the direction of the movement of sinking solid particles in the first barrel, in which the first and second barrels are provided with a level maintaining means, said system being provided with two curtains closing partly the gap between the first barrel and the level maintaining means of the second barrel, said curtains extending down in the bath for preventing floating particles on the bath from crossing and reporting with the solid particles passing into the second barrel.

7. The system of claim 4 for separating sinking solid particles from floating particles, in which the second barrel is attached to the first barrel and is scrolled with respect to the first barrel, in such a way that the evacuation of solid particles through said second barrel is effected by continuing their movement in the same direction as in the first barrel, in which the second barrel is provided with an element linking at least a part of its scrolls in such a way that it prevents the liquid from flowing freely through the linked scrolls, said system being provided with two curtains closing partly the gap between the first barrel and the said element, said curtains extending down in the bath for preventing floating particles on the bath from crossing and reporting with the solid particles passing into the second barrel.

8. The system of claim 1, in which the second barrel is provided with an element linking parts of its scroll in such a way that it prevents the liquid from flowing freely through the linked parts of its scroll.

9. The system of claim 1, wherein said second barrel is provided with an element linking at least a part of its scrolls in such a way that to prevent the liquid from flowing freely through the linked part of said scrolls, and wherein said second barrel has an inner diameter which is greater than that of said first barrel.

10. The system of claim 9 for separating sinking particles from floating particles, further comprising a curtain extending down in the bath for preventing floating particles in the bath from crossing and reporting with the solid particles passing through the bottom of the bath into the second barrel.

11. The system of claim 10, for separating sinking solid particles from floating particles, in which the second barrel is attached to the first barrel and is scrolled with respect to the first barrel, so that the direction of movement of solid particles in said second barrel is reversed with respect to the direction of movement of sinking solid particles in the first barrel, wherein the first and second barrels are provided with a level maintaining means, said system being provided with two curtains partly closing a gap between the first barrel and the level maintaining means of the second barrel, said curtains extending down in the bath for preventing floating particles in the bath from crossing and reporting with the solid particles passing into the second barrel.

12. A system for a solid particles—liquid treatment, said system comprising:

(a) at least one scrolled barrel having scrolls and which is comprised of at least two parts, a first pan containing a liquid wherein the treatment takes place and a second part provided with a means for preventing the freeflow of liquid from out of a bottom of the bath while at the same time allowing for the free passage of solid particles through the bottom of the bath;

(b) means for insuring a substantially uniform liquid level in the bath; and (c) means for rotating the barrel, the barrel being further provided with an element linking parts of said scrolls in said second part so as to define a passage between the barrel and the element, whereby the scrolls and the element prevent the liquid from flowing freely through the passage.

13. The system of claim 12, in which the barrel is rotated along its longitudinal axis, in which the barrel is provided with an inner annular protrusion having such a height that the free end of said protrusion directed towards said longitudinal axis is located at a distance from said longitudinal axis which is at most equal to the distance separating the free ends of the parts of the scrolls adjacent to the said inner annular protrusion, the said inner annular protrusion separating the barrel into the two said parts.

14. The system of claim 13 for preparating sinking solid particles from floating particles, in which the barrel is provided with an element linking parts of its scrolls in its second part in such a way that it prevents the liquid from flowing freely through the linked part of its scrolls and in such a way that a gap is formed between the said element and the protrusion, said system being provided with two curtains closing partly said gap, said curtains extending down in the bath for preventing floating particles from crossing and reporting with the solid particles passing through the gap.

15. The system of claim 12, in which the barrel is provided with an element linking parts of its scroll in its second part in such a way that it prevents the liquid from flowing through the linked parts of its scroll.

16. The system of claim 12, wherein said second part has an inner diameter which is equal to that of said first part of said barrel.

17. A system for a solid particles—liquid treatment, said system comprising:

(a) a scrolled barrel having scrolls, and which is comprised of three parts, (1) a central part containing a liquid bath wherein the treatment takes place, (2) a first end part for feeding solid particles into the bath and which is provided with a means for preventing the freeflow of liquid from out of a bottom of the bath while at the same time allowing for the free passage of solid particles through the bottom into the bath, and (3) a second end part for removing solid particles from out of the bottom of the bath, and which is provided with means for preventing the freeflow of liquid from out of the bottom of the bath while at the same time allowing for the free passage of solid particles through the bottom of the bath, said means of the second end part being an element linking parts of its scrolls so as to define a passage between the barrel and the element, whereby the scrolls and the element prevent the liquid from flowing freely through the passage;

(b) means for insuring a substantially uniform liquid level in the bath; and (c) means for rotating the barrel.

18. The system of claim 17; in which said means of the first end part is an element linking pans of the scrolls of the first end part so as to define a passage between the barrel and the element of the first end part, whereby the scrolls and the element of the first end part prevent liquid from flowing freely through the passage between the barrel and the element of the first end part.

19. The system of claim 17, in which the barrel is provided with two elements, a first element linking parts of the scrolls of said first end part so as to define a passage between the barrel and the first element, whereby the scrolls of the first end part and the first element prevent liquid from flowing freely through the passage between the barrel and the first element, while the second element links parts of the scrolls of its second end part so as to define a passage between the barrel and the second element, whereby the scrolls of the second end part and the second element prevent liquid from flowing freely through the passage between the barrel and the second element of said second end part.

20. The system of claim 17, for separating sinking solid particles from floating particles, in which the barrel is rotated along its longitudinal axis, in which the barrel is provided with an inner annular protrusion having such a height that the free end of said protrusion directed towards said longitudinal axis is located at a distance from said longitudinal axis which is at most equal to the distance separating the free ends of the parts of the scrolls adjacent to the said inner annular protrusion, said inner annular protrusion separating the central part from the second end part, and in which the barrel is provided with an element linking parts of its scrolls in its second end part so as to define a passage between the barrel and the element, whereby the scrolls and the element prevent liquid from flowing freely through the passage between the barrel and the element of said second end part, and so as to define a gap between said element and the protrusion, said gap communicating with the passage, said system being further provided with two curtains closing partly said gap, said curtains extending down in the bath for preventing floating particles from crossing and reporting with the solid particles passing through the gap into the passage.

21. The system of claim 17, for separating sinking solid particles from floating articles, in which the barrel is rotated along its longitudinal axis, in which the barrel is rotated along its longitudinal axis, in which the barrel is provided with an inner annular protrusion having such a height that the free end of said protrusion directed towards said longitudinal axis is located at a distance from said longitudinal axis which is at most equal to the distance separating the free ends of the parts of the scroll adjacent to the said inner annular protrusion, the said inner annular protrusion separating the central part from the second end part, and in which the barrel is provided with an element linking parts of its scroll in its second end part so as to define a passage between the barrel and the element, whereby the scrolls and the element prevent liquid from flowing freely through the passage between the barrel and the element of said second end part, and so as to define a gap between said element and the protrusion, said gap communicating with the passage, said system being further provided with two curtains closing partly said gap, said curtains extending down in the bath for preventing floating particles from crossing and reporting with the solid particles passing through the gap into the passage.

22. A system for a solid particles—liquid treatment, said system comprising:

(a) a first longitudinal scrolled barrel containing a liquid bath in which separation takes places;

(b) a second scrolled barrel, attached to and communicating with said first barrel, said second barrel being provided with means for preventing freeflow of medium from out of the bottom of the bath while at the same time allowing for free passage of solid particles through a bottom of the bath;

(c) means for insuring a substantially uniform liquid level in the bath; and (d) means for rotating the two barrels, wherein said second barrel is provided with an element linking at least a pan of its scrolls in such a way to prevent the liquid from flowing freely through the linked part of said scrolls; and wherein said second barrel has an inner diameter which is greater than that of said first barrel.

* * * * *